US012635728B2

(12) United States Patent
Wu

(10) Patent No.: US 12,635,728 B2
(45) Date of Patent: May 26, 2026

(54) ELECTRONIC CIGARETTE AND ATOMIZER THEREOF

(71) Applicant: SHENZHEN SMOORE TECHNOLOGY LIMITED, Shenzhen (CN)

(72) Inventor: Zhenyu Wu, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 1197 days.

(21) Appl. No.: 16/326,411

(22) PCT Filed: May 14, 2018

(86) PCT No.: PCT/CN2018/086757
§ 371 (c)(1),
(2) Date: Aug. 23, 2021

(87) PCT Pub. No.: WO2019/218122
PCT Pub. Date: Nov. 21, 2019

(65) Prior Publication Data

US 2022/0007728 A1 Jan. 13, 2022

(51) Int. Cl.
*A24F 40/40* (2020.01)
*A24F 40/10* (2020.01)
(Continued)

(52) U.S. Cl.
CPC ..... *A24F 40/40* (2020.01); *A24F 40/42* (2020.01); *A24F 40/485* (2020.01); *A24F 40/10* (2020.01)

(58) Field of Classification Search
CPC ..... A24F 40/00
See application file for complete search history.

(56) References Cited

U.S. PATENT DOCUMENTS 9,955,726 B2 * 5/2018 Brinkley ..... F22B 1/284
10,531,687 B2 * 1/2020 Liu ..... A24F 40/05
(Continued)

FOREIGN PATENT DOCUMENTS

CN 203457809 U 3/2014
CN 203952439 U 11/2014
(Continued)

OTHER PUBLICATIONS

Machine translation of CN 107772541 A (Year: 2024).*
(Continued)

*Primary Examiner* — Michael H. Wilson
*Assistant Examiner* — Tobey C Le
(74) *Attorney, Agent, or Firm* — Andrew C. Cheng

(57) ABSTRACT

The invention relates to an electronic cigarette and an atomizer thereof, wherein the atomizer includes a base, a liquid accumulator and an atomizing assembly; the liquid accumulator is mounted at the top of the base and includes a liquid storage cavity and an atomizing cavity communicated with the liquid storage cavity, and the atomizing assembly is mounted in the atomizing cavity; the base includes a base body, and an air inlet hole communicated with the atomizing cavity is formed at the base body; the atomizer also includes a bottom cover covering the bottom of the base body, and the bottom cover is formed with an air inlet; the bottom surface of the base body is formed with at least one diversion trench communicating the air inlet with the air inlet hole. The invention has the beneficial effects that the diversion trench at the bottom surface of the base is arranged to lengthen the length of the air flow passage, thereby making the liquid smoke difficult to leak.

12 Claims, 4 Drawing Sheets

(51) Int. Cl.
*A24F 40/42* (2020.01)
*A24F 40/485* (2020.01)

(56) References Cited

U.S. PATENT DOCUMENTS

| | | | | |
|---|---|---|---|---|
| 11,039,641 | B2 * | 6/2021 | Liu | A24F 40/05 |
| 2017/0224014 | A1 | 8/2017 | Fraser | |
| 2018/0056016 | A1 * | 3/2018 | Qiu | A24F 40/51 |

FOREIGN PATENT DOCUMENTS

| | | | | | |
|---|---|---|---|---|---|
| CN | 204048024 | U | | 12/2014 | |
| CN | 104522891 | A | | 4/2015 | |
| CN | 204540841 | U | | 8/2015 | |
| CN | 105212274 | A | | 1/2016 | |
| CN | 205794808 | U | | 12/2016 | |
| CN | 106983177 | A | | 7/2017 | |
| CN | 206390306 | U | | 8/2017 | |
| CN | 207040891 | U | | 2/2018 | |
| CN | 107772541 | A | * | 3/2018 | A24F 47/00 |
| GB | 201605104 | | | 5/2016 | |
| GB | 2550540 | A | | 11/2017 | |
| KR | 10-2018-0043341 | A | | 4/2018 | |
| WO | 2015149311 | A1 | | 10/2015 | |
| WO | 2016061730 | A1 | | 4/2016 | |
| WO | 2016095220 | A1 | | 6/2016 | |
| WO | WO-2017197703 | A1 | * | 11/2017 | A24B 15/167 |
| WO | WO-2017206480 | A1 | * | 12/2017 | A24F 40/00 |
| WO | 2018000829 | A1 | | 1/2018 | |
| WO | WO-2018040981 | A1 | * | 3/2018 | A24F 47/00 |

OTHER PUBLICATIONS

Machine translation of WO 2017197703 A1 (Year: 2025).*
Machine translation of WO 2017206480 A1 (Year: 2025).*
Machine translation of WO 2018040981 A1 (Year: 2025).*
CNIPA (ISA), ISA Search Report for PCT/CN2018/086757, Nov. 26, 2018, total pp. 7 (incl. translation).
CNIPA (ISA), Written Opinion of ISA on Search Report for PCT/CN2018/086757, Nov. 26, 2018, total pp. 11 (incl. translation).
CNIPA, Notification of a First Office Action for CN201810467824.8, with search report, Jun. 5, 2023, total pp. 22 (incl. translation).
CNIPA, Notification to grant patent right for invention in CN201810467824.8, Sep. 1, 2023, total pp. 6 (incl. translation).

* cited by examiner

ELECTRONIC CIGARETTE AND ATOMIZER THEREOF

TECHNICAL FIELD

The present invention relates to a product for smokers, and more particularly to an electronic cigarette and an atomizer thereof.

BACKGROUND

Electronic cigarettes are also known as virtual cigarettes and electronic atomizers. As an alternative cigarette, electronic cigarettes are mostly used for smokers to quit smoking. The electronic cigarettes have similar appearance and tastes to cigarettes, but generally do not contain harmful components such as tar, particulate matter, etc. in cigarettes.

An electronic cigarette in the related art includes an atomizer and a battery pack detachably connected to the atomizer. The atomizer further includes a base with an air inlet hole, a liquid storage cavity mounted to the base for storing liquid smoke, a smoke tube disposed in the liquid storage cavity and communicated with the air inlet hole, and an atomizing assembly disposed in the smoke tube and communicated with the liquid storage cavity. During operation, the atomizing assembly is energized and heats and atomizes the liquid smoke, and the air enters the smoke tube through the air inlet hole to carry away the smoke. The electronic cigarette satisfies user needs to a certain extent, but there is a possibility that the liquid smoke easily leaks from the air inlet hole to the outside of the electronic cigarette, thereby causing pollution.

SUMMARY OF THE DISCLOSURE

The technical problem to be solved by the present invention is to provide an improved electronic cigarette and an atomizer thereof.

The technical solution adopted by the present invention to solve one of the technical problems is to provide an electronic cigarette atomizer, including a base, a liquid accumulator and an atomizing assembly; the liquid accumulator is mounted to the top of the base and includes a liquid storage cavity and an atomizing cavity communicating with the liquid storage cavity, and the atomizing assembly is installed in the atomizing cavity; the base includes a base body, wherein the base body is formed with an air inlet hole communicated with the atomizing cavity; the atomizer further includes a bottom cover covering the bottom of the base body, and the bottom cover is formed with an air inlet; the bottom surface of the base body is formed with at least one diversion trench that communicates the air inlet with the air inlet hole.

In some embodiments, the at least one diversion trench is a flat trench.

In some embodiments, the atomizer further includes an electrode mounted in the base body; the bottom cover includes a bottom wall in close contact with the bottom surface of the base body, the bottom wall is formed with an electrode mounting hole for the electrode to penetrate through, and a gap is formed between the hole wall of the electrode mounting hole and the side wall of the electrode, the gap forming the air inlet.

In some embodiments, the aperture of the electrode mounting hole is larger than the diameter of the electrode.

In some embodiments, the bottom cover includes a side wall surrounding the periphery of the bottom wall, and the side wall is provided with a snap hole for snapping the second snap portion of the base body.

In some embodiments, the bottom cover includes a structure made of magnetically permeable material.

In some embodiments, the base body includes two spaced-apart electrode mounting holes and two spaced-apart air inlet holes; the at least one diversion trench includes a first diversion trench and a second diversion trench intersecting with the first diversion trench, with the first diversion trench connecting the two electrode mounting holes and the second diversion trench connecting the two air inlet holes.

In some embodiments, the first diversion trench and the second diversion trench are crisscrossed.

In some embodiments, the liquid accumulator includes a cylindrical liquid storage casing and a smoke tube axially disposed in the liquid storage casing. A gap is formed between the inner wall of the liquid storage casing and the outer wall of the smoke tube and the gap forms the liquid storage cavity.

In some embodiments, the atomizing cavity is formed in the smoke tube, wherein a through hole is provided to a position of the smoke tube corresponding to the atomizing cavity, and the through hole communicates the atomizing cavity with the liquid storage cavity.

In some embodiments, the atomizing assembly includes a heating unit and an oil trapping member that surrounds the periphery of the heating unit, and the oil trapping member is disposed corresponding to the through hole.

Some embodiments further include a casing sleeved on a combination of the base and the liquid accumulator and including a mouthpiece portion located at the top thereof, wherein the mouthpiece portion communicates with the smoke tube in the liquid accumulator.

In some embodiments, the base includes a first calking groove, and the liquid accumulator includes a second inserting portion; the second inserting portion is correspondingly inserted in the first calking groove; the second inserting portion has a tubular shape, and a sealing member is inserted therein and the middle of the sealing member is provided with an air flow tube communicating the atomizing cavity with the air inlet hole.

In some embodiments, the sealing member is provided with a blind hole corresponding to the electrode, and the electrode lead of the atomizing assembly pierces through the barrier wall of the blind hole, and then electrically connects to the electrode.

In some embodiments, the liquid accumulator includes a second calking groove for inserting a first inserting portion of the base.

An electronic cigarette is provided, including the electronic cigarette atomizer of any of the above.

The invention has beneficial effects that the diversion trench of the bottom surface of the base is arranged to lengthen the length of the air flow passage, thereby making the liquid smoke difficult to leak.

In addition, the diversion trench is provided as a flat trench, so that even if the liquid smoke enters therein, it is difficult to flow out due to large viscosity. During the inhalation process, the liquid smoke in the trench can be brought back into the atomizing cavity to greatly reduce liquid leakage phenomena.

BRIEF DESCRIPTION OF THE DRAWINGS

The present invention will be further described below in conjunction with the accompanying drawings and embodiments, wherein.

PREFERRED EMBODIMENTS

To give a better understanding for the technical features, objects and effects of the present invention, the embodiments of the present invention are described in detail with reference to the accompanying drawings.

Figure 1:
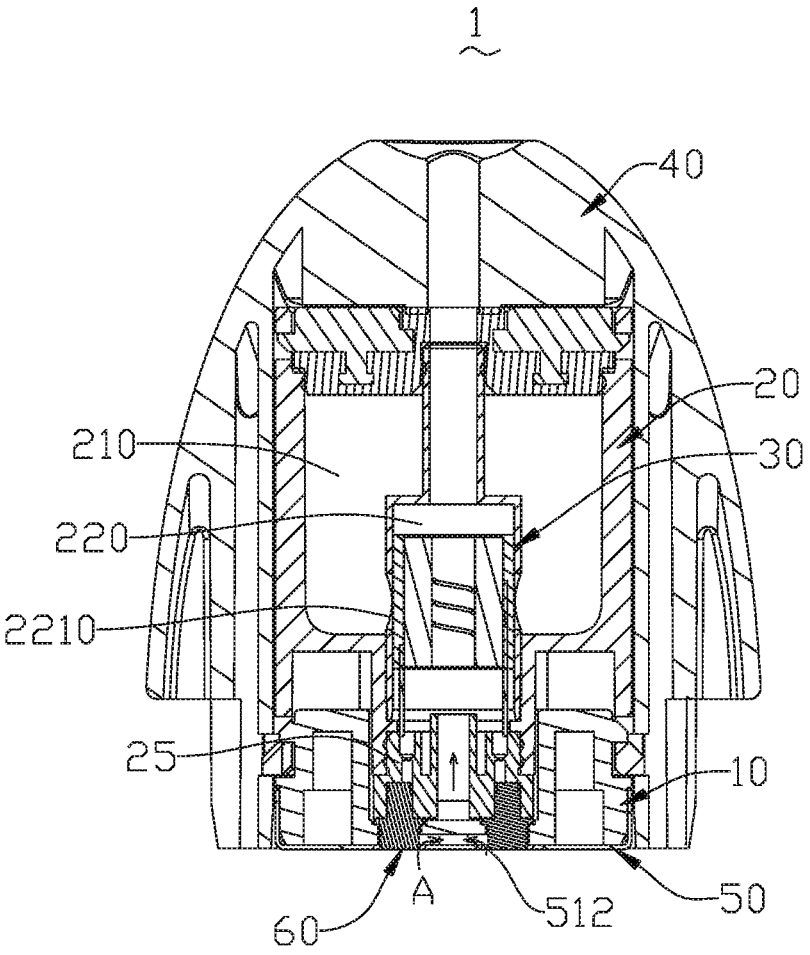
FIG. 1 is a schematic longitudinal cross-sectional structural view of an electronic cigarette atomizer in some embodiments of the present invention.
Figure 2:
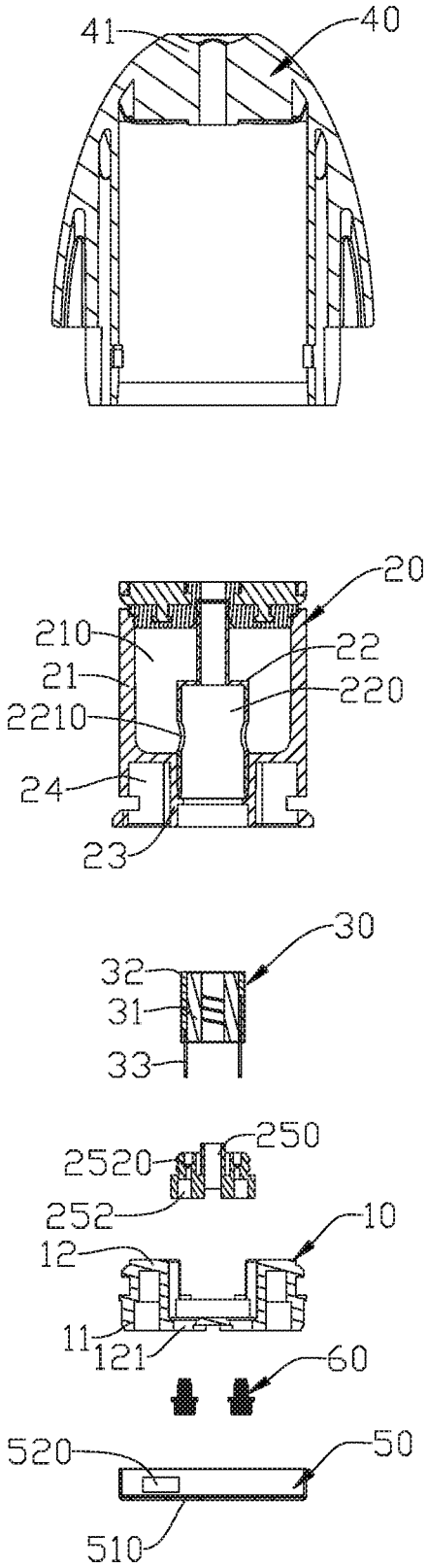
FIG. 2 is a schematic longitudinal cross-sectional exploded view of the electronic cigarette atomizer of FIG. 1.
Figure 3:
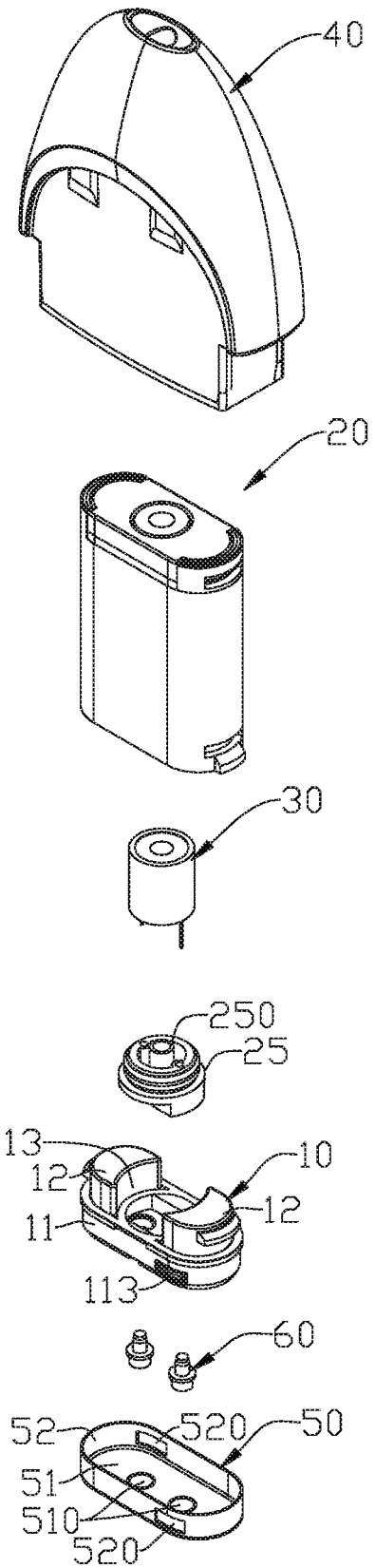
FIG. 3 is a schematic exploded perspective view of the electronic cigarette atomizer of FIG. 1.

FIGS. 1-3 illustrate an electronic cigarette atomizer 1 in accordance with some embodiments of the present invention, wherein the atomizer 1 may be combined with a battery pack (not shown) to form an electronic cigarette. As shown, the atomizer 1 may include a base 10, a liquid accumulator 20 mounted to the top of the base 10, an atomizing assembly 30 mounted inside the liquid accumulator 20, an outer casing 40 disposed outside a combination of the base 10 and liquid accumulator 20, a bottom cover 50 mounted to the bottom of the base 10, and an electrode 60 mounted in the base 10.

The base 10 may be integrally formed of plastic material in some embodiments, wherein the base includes a base body 11 which is substantially race track-shaped, two first inserting portions 12 spaced apart and disposed at the top of the base body 11, and a first calking groove 13 formed between the two first inserting portions 12. A first snap portion 120 protruding outward is formed at the outer side wall of each of the first inserting portions 12 for snap connection with the liquid accumulator 20. A second snap portion 113 may be formed at the side wall of the base body 11 for snapping the bottom cover 50. The bottom cover 50 is formed with an air inlet.

Figure 4:
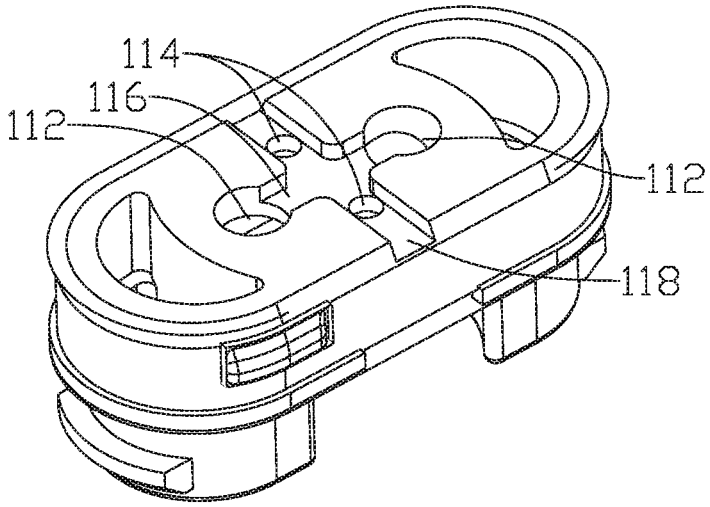
FIG. 4 is a schematic perspective structural view of the base of the electronic cigarette atomizer of FIG. 1 with the bottom surface facing upward.

Referring to FIG. 4 as well, the base body 11 may include two electrode mounting holes 112 and two air inlet holes 114 in some embodiments. The two electrode mounting holes 112 and the two air inlet holes 114 are both through holes in a longitudinal direction from the top surface to the bottom surface of the base body 11. The bottom surface of the base body 11 is formed in a plane perpendicular to the longitudinal direction with a first diversion trench 116 and a second diversion trench 118 which are crisscrossed, wherein the first diversion trench 116 connects the two electrode mounting holes 112, and the second diversion trench 118 connects the two air inlet holes 114, so as to guide air from the air inlet of the bottom cover 50 to change direction from a length direction of the first diversion trench 116 to a length direction of the second diversion trench 118 in the plane perpendicular to the longitudinal direction. The two electrode mounting holes 112 are respectively at two ends of one of the two intersected diversion trenches, and the two air inlet holes 114 are respectively at two opposite sides of the one of the two intersected diversion trenches, defining an air flow passage that guides air from the air inlets of the bottom cover 50 in the longitudinal direction to turn to the plane perpendicular to the longitudinal direction, change directions in the plane between the two intersected diversion trenches, and turn to the air inlet holes 114 in the longitudinal direction. The first diversion trench 116 and the second diversion trench 118 are flat trenches in some embodiments, that is, the trench depth is smaller than the trench width. The first diversion trench 116 and the second diversion trench 118 is arranged to lengthen the length of the air flow passage, thereby making the liquid smoke difficult to leak. In addition, since both are flat trenches, even if the liquid smoke enters therein, it is difficult to flow out due to large viscosity. During the inhalation process, the liquid smoke in the trench can be brought back into the atomizing cavity 220 to greatly reduce liquid leakage phenomena.

The liquid accumulator 20 may, in some embodiments, include a cylindrical liquid storage casing 21 and a smoke tube 22 axially disposed in the liquid storage casing 21, wherein a gap is formed between the inner wall of the liquid storage casing 21 and the outer wall of the smoke tube 22 and the gap forms a liquid storage cavity 210. The smoke tube 22 is in the form of a stepped shaft in some embodiments, wherein an atomizing cavity 220 is formed within a portion of the smoke tube 22 with a larger diameter for receiving the atomizing assembly 30 therein to atomize the liquid smoke. A through hole 2210 is further provided to a position of the sidewall of the smoke tube 22 corresponding to the atomizing cavity 220 to communicate the atomizing cavity 220 with the liquid storage cavity 210. The atomizing assembly 30 is disposed in the atomizing cavity 220 corresponding to the through hole 2210 to allow the liquid smoke in the liquid storage cavity 210 to flow to the atomizing assembly 20.

The liquid accumulator 20 may, in some embodiments, include a second inserting portion 23 and a second calking groove 24 located at two sides of the second inserting portion 23, wherein the second inserting portion 23 is correspondingly inserted in the first calking groove 13 of the base 10, and the second calking groove 24 is configured for inserting the first inserting portion 12 of the base 10. The second inserting portion 23 has a tubular shape, and a sealing member 25 is inserted therein. The sealing member 25 may be made of a soft material such as silica gel, and an air flow tube 250 communicated with the atomizing cavity is formed in the middle of the sealing member 25 to allow the air to flow from the base 10 into the atomizing cavity 220. The air flow tube 250 also communicates with the air inlet hole 114 of the base 10. A blind hole 252 is disposed at each side of the air flow tube 250, and the two blind holes 252 are respectively disposed corresponding to the two electrodes 60. The electrode leads 33 of the atomizing assembly 30 pierce through the barrier wall 2520 of the two blind holes 252 respectively, and then electrically connect to the two electrodes 60. An air flow passage for external air to the atomizing cavity 220 is defined sequentially through the air inlet of the bottom cover 50, the first diversion trench 116, the second diversion trench 118, the air inlet hole 114, and the air flow tube 250.

The atomizing assembly 30 may, in some embodiments, include a heating unit 31 and an oil trapping member 32 wrapping around the periphery of the heating unit 31. The oil trapping member 32 may be a cotton-like porous structure in some embodiments, and it is positioned corresponding to the through hole 2210 to absorb the liquid smoke. When the heating unit 31 is energized and generates heat, it atomizes the liquid smoke in the oil trapping member 32.

The outer casing 40 is sleeved on a combination of the base 10 and the liquid accumulator 20 and includes a mouthpiece portion 41 located at the top thereof, wherein the mouthpiece portion 41 communicates with the top of the smoke tube 22 in the liquid accumulator 20 to draw smoke.

In some embodiments, the bottom cover 50 includes a bottom wall 51 in close contact with the bottom surface of the base body 11 and a side wall 52 that surrounds the periphery of the bottom wall 51. The bottom wall 51 is provided with an electrode mounting hole 510 through which the electrode 60 penetrates. The side wall 52 is provided with a snap hole 520 for snapping the second snap portion 113 of the base 10. The aperture of the electrode mounting hole 510 is larger than the diameter of the electrode 60, so that an air inlet hole 512 is formed between the hole wall of the electrode mounting hole 510 and the outer wall of the electrode 60, wherein the air inlet hole 512 communicates with the first diversion trench 116 and further with the air inlet hole 114 of the base 11 such that the air is allowed to enter the atomizer 1 in the direction of arrow A shown in FIG. 1. The bottom cover 50 may be made of a magnetically permeable material in some embodiments to enable its adsorption with a magnet of the battery pack to effect a magnetic connection between the atomizer 1 and the battery pack. In this way, additional magnets mounted to absorb the battery pack can be omitted.

The above is only the embodiments of the present invention and is not intended to limit the scope of the invention. The equivalent structure or equivalent process transformation of the description and the contents of the drawings of present invention that may be directly or indirectly applied to other related art is included in the scope of patent protection of the present invention.

What is claimed is:

1. An electronic cigarette atomizer, comprising a base, a liquid accumulator and an atomizing assembly;

the liquid accumulator is mounted to the top of the base and comprises a liquid storage cavity and an atomizing cavity communicated with the liquid storage cavity, and the atomizing assembly is mounted in the atomizing cavity; the base comprises a base body, wherein the base body is formed with an air inlet hole communicated with the atomizing cavity; the atomizer further comprises a bottom cover covering the bottom of the base body, and the bottom cover is formed with an air inlet; a bottom surface of the base body is formed with at least one diversion trench that communicates the air inlet with the air inlet hole;

wherein the atomizer further comprises an electrode mounted in the base body, the bottom cover is formed with an electrode mounting hole, the electrode mounting hole is a through hole in a longitudinal direction from a top surface to the bottom surface of the base body, the electrode penetrates through the electrode mounting hole, an aperture of the electrode mounting hole is larger than a diameter of the electrode such that a gap forming the air inlet is formed between a hole wall of the electrode mounting hole and a side wall of the electrode;

the air inlet hole is a through hole in the longitudinal direction from the top surface of the base body to the bottom surface of the base body; the depth of the at least one diversion trench in the longitudinal direction is smaller than the width of the at least one diversion trench, the at least one diversion trench comprises a first diversion trench and a second diversion trench in a plane perpendicular to the longitudinal direction, one end of the first diversion trench communicates with the electrode mounting hole, the second diversion trench communicates with a bottom of the air inlet hole, and the first diversion trench and the second diversion trench are crisscrossed on the bottom surface of the base body, so as to guide air from the air inlet to change direction from a length direction of the first diversion to a length direction of the second diversion trench in the plane perpendicular to the longitudinal direction;

wherein a sealing member is inserted into a bottom of the liquid accumulator, an air flow tube communicated with the atomizing cavity at a top of the air flow tube is formed in the sealing member, the air flow tube communicates with the air inlet hole at a bottom of the air flow tube to allow the air to flow from the base into the atomizing cavity; and wherein an air flow passage for external air to the atomizing cavity is defined sequentially through the air inlet, the first diversion trench, the second diversion trench, the air inlet hole, and the air flow tube.

2. The electronic cigarette atomizer of claim 1, wherein the bottom cover comprises a bottom wall in close contact with the bottom surface of the base body and a side wall that surrounds a periphery of the bottom wall, and the side wall is provided with a snap hole for snapping a second snap portion of the base body.

3. The electronic cigarette atomizer of claim 1, wherein the bottom cover comprises a structure made of magnetically permeable material.

4. The electronic cigarette atomizer of claim 1, wherein the base body comprises two spaced-apart electrode mounting holes and two spaced-apart air inlet holes; and the first diversion trench connects the two electrode mounting holes and the second diversion trench connects the two air inlet holes.

5. The electronic cigarette atomizer of claim 1, wherein the liquid accumulator comprises a cylindrical liquid storage casing and a smoke tube axially disposed in the liquid storage casing, wherein a gap is formed between an inner wall surface of the liquid storage casing and an outer wall surface of the smoke tube, the gap forming the liquid storage cavity.

6. The electronic cigarette atomizer of claim 5, wherein the atomizing cavity is formed in the smoke tube, wherein a through hole is provided to a position of the smoke tube corresponding to the atomizing cavity and the through hole communicates the atomizing cavity with the liquid storage cavity.

7. The electronic cigarette atomizer of claim 6, wherein the atomizing assembly comprises a heating unit and an oil trapping member wrapping around a periphery of the heating unit, wherein the oil trapping member is disposed corresponding to the through hole.

8. The electronic cigarette atomizer of claim 6, wherein the electronic cigarette atomizer further comprises a casing, wherein the casing is sleeved on a combination of the base and the liquid accumulator and comprises a mouthpiece portion located at the top thereof, wherein the mouthpiece portion communicates with the smoke tube in the liquid accumulator.

9. The electronic cigarette atomizer of claim 1, wherein the base comprises a first receiving groove and the liquid accumulator comprises a second inserting portion; the second inserting portion is correspondingly inserted in the first receiving groove; the second inserting portion has a tubular shape and the sealing member is inserted in the second inserting portion, wherein the middle of the sealing member is provided with the air flow tube communicating the atomizing cavity with the air inlet hole.

10. The electronic cigarette atomizer of claim 9, wherein a blind hole corresponding to the electrode is disposed at the sealing member, and an electrode lead of the atomizing assembly pierces through a barrier wall of the blind hole and then electrically connects to the electrode.

11. The electronic cigarette atomizer of claim 1, wherein the liquid accumulator comprises a second calking receiving groove, wherein the second calking receiving groove is configured for inserting a first inserting portion of the base.

12. An electronic cigarette atomizer, comprising:

a bottom cover, comprising a bottom wall, and a side wall that surrounds a periphery of the bottom wall, wherein the bottom wall is formed with two electrode mounting holes penetrating the bottom wall in a longitudinal direction;

a base, disposed in the bottom cover and comprising a base body, wherein a bottom surface of the base body facing towards the bottom wall of the bottom cover is formed with two intersected diversion trenches, the diversion trenches are flat trenches running along the bottom surface of the base body, the depths in the longitudinal direction of the diversion trenches are smaller than the widths in a plane perpendicular to the longitudinal direction of the diversion trenches; and the base body is formed with two spaced-apart electrode mounting holes and two spaced-apart air inlet holes, the two spaced-apart electrode mounting holes penetrate through the base body in the longitudinal direction and communicate with one of the two intersected diversion trenches, and the two spaced-apart air inlet holes penetrate through the base body in the longitudinal direction and communicate with the other of the two intersected diversion trenches;

a liquid accumulator, mounted to the top of the base and comprising a liquid storage cavity and an atomizing cavity communicated with the liquid storage cavity, wherein the atomizing cavity is communicated with the two spaced-apart air inlet holes;

an atomizing assembly, mounted in the atomizing cavity; and two electrodes, mounted in the base body and respectively penetrating through the two electrode mounting holes of the bottom cover and the two spaced-apart electrode mounting holes of the base body, apertures of the two electrode mounting holes of the bottom cover are larger than diameters of the two electrodes such that two air inlets in the longitudinal direction are formed between hole walls of the two electrode mounting holes and side walls of the two electrodes, and the two air inlets are communicated with the two air inlet holes through the two intersected diversion trenches;

wherein the two electrode mounting holes are respectively at two ends of one of the two intersected diversion trenches, and the two air inlet holes are respectively at two opposite sides of the one of the two intersected diversion trenches, defining an air flow passage that guides air from the air inlets in the longitudinal direction to turn to the plane perpendicular to the longitudinal direction, change directions in the plane between the two intersected diversion trenches, and turn to the air inlet holes in the longitudinal direction.

* * * * *